US012256798B2

(12) United States Patent
Yang

(10) Patent No.: US 12,256,798 B2
(45) Date of Patent: Mar. 25, 2025

(54) FLIP-UP HELMET WITH A BREATHING NOSE MASK

(71) Applicant: AN YNG ENTERPRISE CO., LTD., Tainan (TW)

(72) Inventor: Zhong Qi Yang, Tainan (TW)

(73) Assignee: AN YNG ENTERPRISE CO., LTD., Tainan (TW)

( * ) Notice: Subject to any disclaimer, the term of this patent is extended or adjusted under 35 U.S.C. 154(b) by 0 days.

(21) Appl. No.: 18/209,993

(22) Filed: Jun. 14, 2023

(65) Prior Publication Data

US 2024/0277098 A1 Aug. 22, 2024

(30) Foreign Application Priority Data

Feb. 21, 2023 (TW) ..... 112106233

(51) Int. Cl.
*A42B 3/20* (2006.01)
*A42B 3/28* (2006.01)

(52) U.S. Cl.
CPC ..... *A42B 3/20* (2013.01)

(58) Field of Classification Search
CPC ..... A42B 3/20
See application file for complete search history.

(56) References Cited

U.S. PATENT DOCUMENTS 354,658 A * 12/1886 Runge et al. ..... A62B 17/04 128/206.28
618,001 A * 1/1899 Beach ..... A01K 55/00 2/172
1,041,610 A * 10/1912 Fabian ..... A62B 17/006 2/5
1,176,901 A * 3/1916 Jessup ..... A62B 17/04 128/201.23
2,314,889 A * 3/1943 Manson ..... A62B 17/04 2/9
2,642,574 A * 6/1953 Eloranta ..... A42B 1/046 2/205
2,860,632 A * 11/1958 Conti ..... A62B 17/04 D24/110.2
3,098,233 A * 7/1963 Hoagland ..... A62B 17/04 2/205
3,258,010 A * 6/1966 Austin ..... A62B 18/04 D24/110.2
3,433,222 A * 3/1969 Pinto ..... B63C 11/26 128/201.27
3,528,415 A * 9/1970 Malmin ..... A41D 13/11 128/202.13

(Continued)

*Primary Examiner* — Robert H Muromoto, Jr.
(74) *Attorney, Agent, or Firm* — Law office of Michael Chen; Ying-Ting Chen

(57) ABSTRACT

A flip-up helmet with a breathing nose mask includes a body, the front end of which is a hollow portion, and the body having a first side and a second side, the first side being combined with a first cheek lining, the second side being combined with a second cheek lining, the second cheek lining being provided with a first magnetic element, and the front end of the body being installed with a liftable face shield covered over the entire hollow portion; and a breathing nose mask, the first end of which is fixed to the first side of the body, the second end of the breathing nose mask being provided with a second magnetic element for attracting with the first magnetic element, so the second end of the breathing nose mask is movably combined with the second side of the body or away from it.

4 Claims, 6 Drawing Sheets

(56) References Cited

U.S. PATENT DOCUMENTS 4,141,086 A * 2/1979 Jackson ..... A42C 5/04 2/909
4,296,746 A * 10/1981 Mason, Jr. ..... A62B 18/02 128/201.15
4,336,799 A * 6/1982 Almasi ..... A62B 18/04 128/201.24
4,411,023 A * 10/1983 Pinson ..... A62B 17/04 D24/110.2
4,589,408 A * 5/1986 Singer ..... A41D 13/1153 2/205
4,610,247 A * 9/1986 Stroup ..... A42B 3/28 128/201.28
4,667,667 A * 5/1987 Schnoor ..... A62B 9/06 128/201.24
4,768,235 A * 9/1988 Webster ..... A42C 5/04 2/205
4,817,596 A * 4/1989 Gallet ..... A42B 3/14 128/201.24
5,016,625 A * 5/1991 Hsu ..... A62B 17/04 128/206.16
5,062,163 A * 11/1991 Avey ..... A42B 1/0187 2/909
5,109,549 A * 5/1992 Mattinson ..... A62B 17/04 2/205
5,251,336 A * 10/1993 Nevins ..... A42B 1/046 2/205
5,839,432 A * 11/1998 Daneshvar ..... A42C 5/04 2/205
6,442,767 B1 * 9/2002 Meckes ..... A42B 3/288 2/10
6,626,178 B2 * 9/2003 Morgan ..... B63C 11/12 128/201.27
8,020,552 B2 * 9/2011 Dillon ..... A62B 17/04 2/457
8,555,418 B2 * 10/2013 Singh ..... A42B 1/0186 2/173
11,684,103 B2 * 6/2023 Lowder ..... A41D 13/11 2/84

* cited by examiner

FLIP-UP HELMET WITH A BREATHING NOSE MASK

FIELD OF INVENTION

The present invention is applied to the flip-up helmet, in particular, after the face shield of the flip-up helmet is lifted, a breathing nose mask can be easily opened so that the wearer can comfortably eat while still achieving the effect of keeping warm.

BACKGROUND OF THE INVENTION

In general, the helmet is roughly divided into full-face flip-up helmet and full-face helmet, both of them are actually very similar in their type, the face shield of the full-face flip-up structure in the front is designed to be movable, which can be lifted up with a plastic shield, so as to facilitate the helmet body of putting on, taking off, or eating for the wearer. The full-face type helmet can completely cover the head to provide the best protection, for most of the racing or in the cold snow area users, it is relatively more difficult to put on or take off the helmet, and with the disadvantages of not being able to eat under the wearing state, especially when wearing the full-face design of helmet in a cold weather, it will affect the wearer's vision due to the fogging of the helmet face shield caused by the temperature difference of exhaling hot air by the wearer and the outdoor climate. As a result, some manufacturers have developed a defogging device on the shield or installed a breathing nose mask in the helmet to prevent exhaled hot air from rising and fogging the shield. For example, U.S. Pat. No. 6,748,607, a breathing protection device component for helmets, can effectively prevent the formation of vapor in the helmet shield, thereby eliminating any inconvenience when wearing the helmet, and U.S. Pat. No. 11,297,891 is a helmet comprising a face shield assembly with a breathing protection device component, the face shield assembly comprising a face shield pivotally attached to the outer shell of the helmet and having an inner surface facing a chamber when in a lowered position. The face shield assembly also comprises a breathing protection device provided under the face shield, the breathing protection device being a contact surface of a flexible member, the shape of the contact surface being configured to engage the wearer's face around the nose and connect to the mouth for deflecting moist air away from the inner surface of the shield. However, in cold climates, full-face helmets are worn for extended periods of time, requiring the helmet to be removed for eating or drinking, which can cause physical discomfort when the wearer's head is exposed to the cold climate. Although the flip-up full-face helmet can lift up the shield to eat, because the shield is equipped with the breathing protection component, which is blocked by the top edge of the helmet when the face shield is lifted up and cannot open a larger space, causing inconvenience in use.

SUMMARY OF THE INVENTION

In view of the flip-up full-face helmet, when the face shield is lifted up, the breathing component on the shield is blocked by the top edge of the helmet and cannot open up a larger space, making it inconvenient to use.

Therefore, the purpose of the present invention is to fix one end of the breathing nose mask to one side of the helmet body, and the other end of the breathing nose mask can be movably combined with the other side of the helmet body by means of a binding part, because the breathing nose mask is not combined with the face shield, so that the face shield does not affect the lifting range when the helmet wearer lifts the face shield up, and it is convenient to achieve the effect of eating or drinking.

In order to accomplish the foregoing purpose, the present invention provides a flip-up helmet with a breathing nose mask comprising a body, the front end of which is a hollow portion, and the body having a first side and a second side, the first side being combined with a first cheek lining, the second side being combined with a second cheek lining, the second cheek lining being provided with a first magnetic element, and the front end of the body being hinged with a liftable face shield covered over the entire hollow portion; and a breathing nose mask, the first end of which can be fixed to the first side of the body, the second end of the breathing nose mask being provided with a second magnetic element for attracting with the first magnetic element, so that the second end of the breathing nose mask can be movably combined with the second side of the body or away from it, and the bottom of the breathing nose mask having a bonding part for the cold-resistant cover to be combined together to form a helmet with cold-resistant effect.

In a further embodiment of the present invention, the breathing nose mask has a third magnetic element near the first end and the outer edge of the first side of the body has a sixth magnetic element for attracting the third magnetic element so that the lifted breathing nose mask can be secured to the sixth magnetic element by the third magnetic element.

In a further embodiment of the present invention, the bonding part on the bottom of the breathing nose mask comprises two bonding pieces located on the both sides of the outer edge of the bottom of the breathing nose mask and a fourth magnetic element located in the middle of the bottom of the breathing nose mask.

In a further embodiment of the present invention, the bottom of the body can be connected with a cold-resistant cover, the upper edge of the cold-resistant cover has a binding part which can be connected to the body, and the cold-resistant cover is provided with a connecting piece and a fifth magnetic element at the position corresponding to the bonding part of the breathing nose mask.

Based on the above, by fixing the breathing nose mask in front of the helmet body, the opening range of the face shield is not affected when it is lifted up, on the other hand, one end of the breathing nose mask is fixed to the helmet body and the other end can be movably lifted for the convenience of the wearer to eat, at the same time, the bottom of the breathing nose mask is combined with a cold-resistant cover, which can achieve the effect of keeping out the cold.

DETAILED DESCRIPTION OF THE PREFERRED EMBODIMENTS

Figure 1:
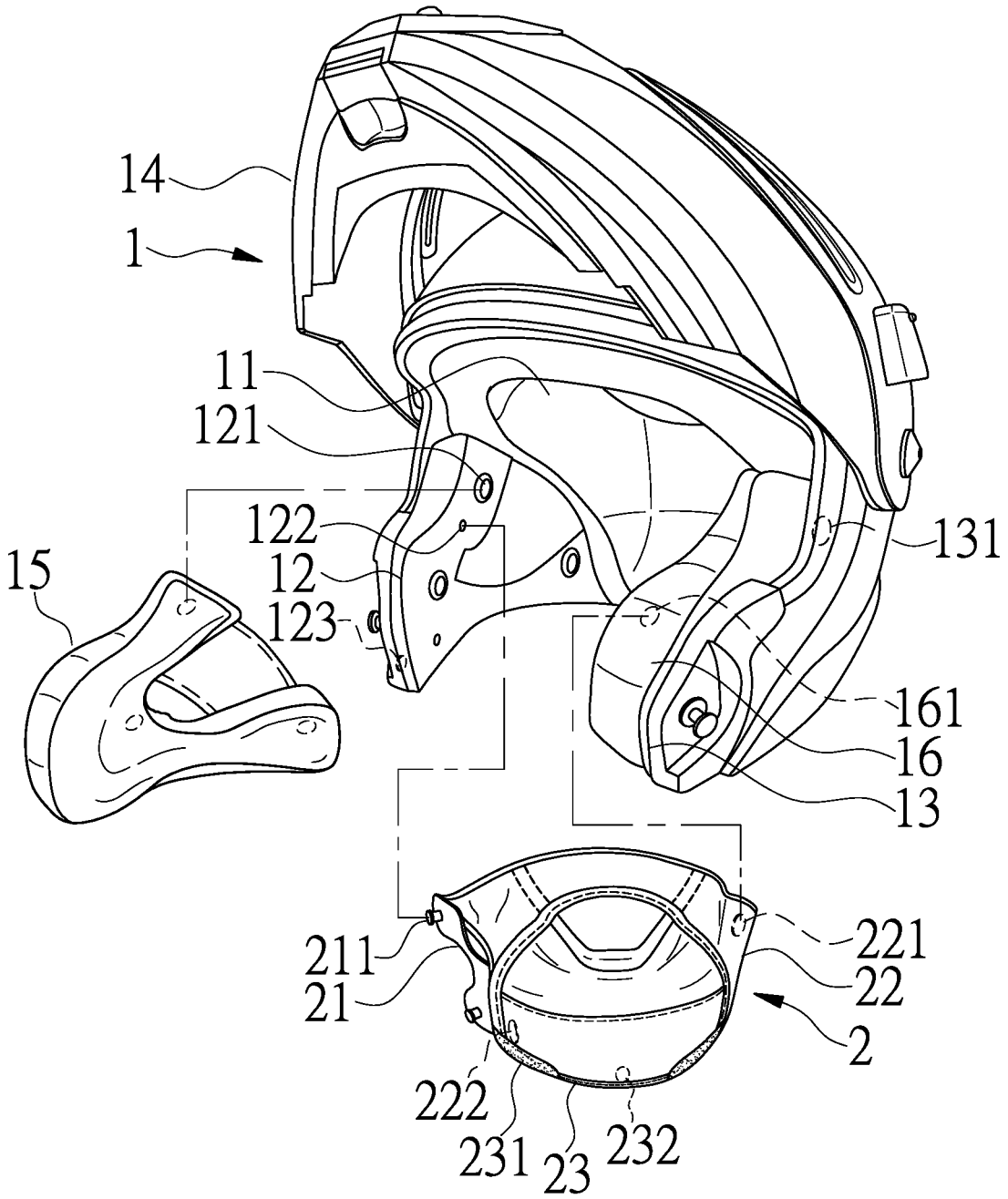
FIG. 1 is a three-dimensional exploded view of the present invention.
Figure 2:
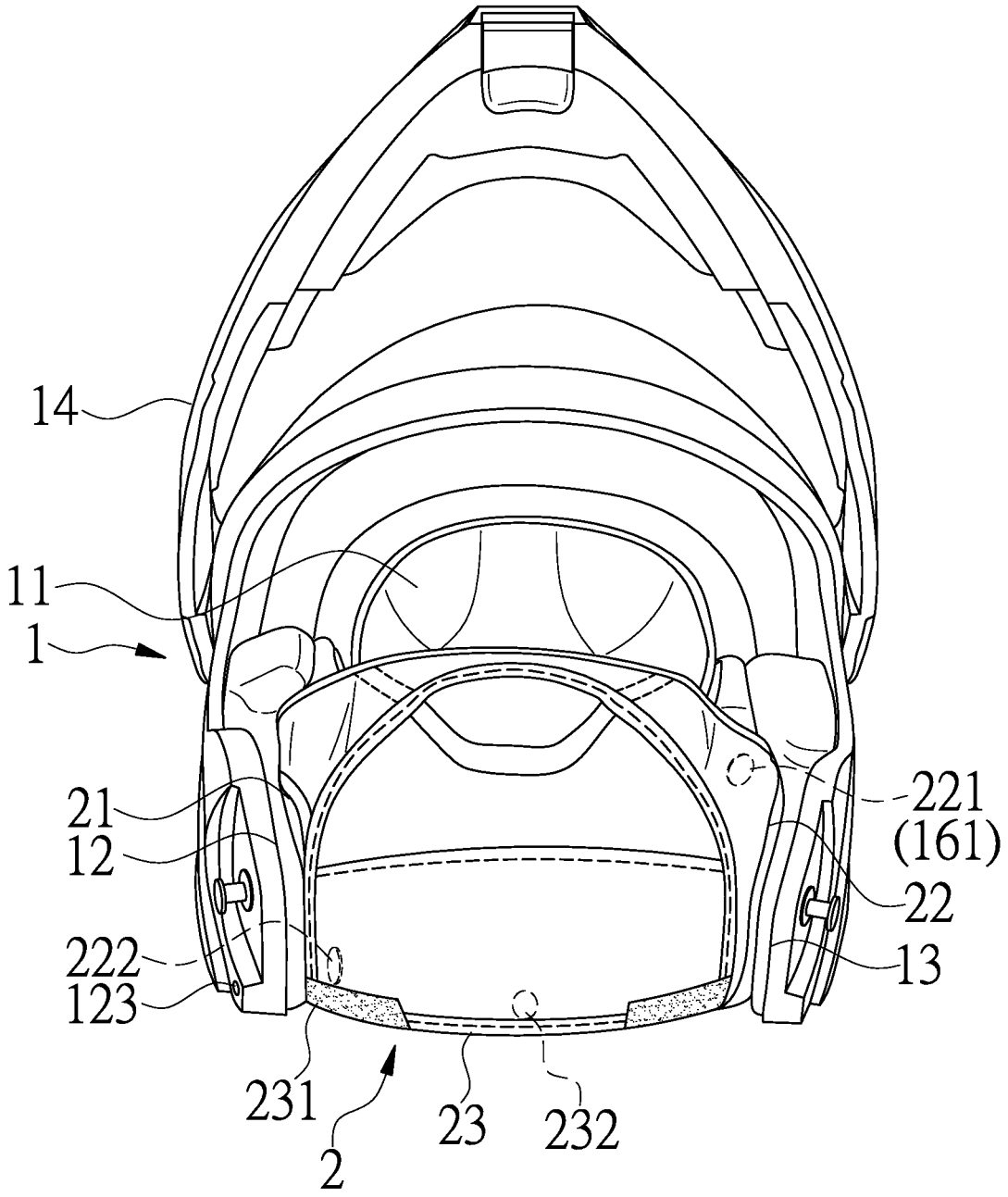
FIG. 2 is a schematic view of the assembly of the present invention.
Figure 3:
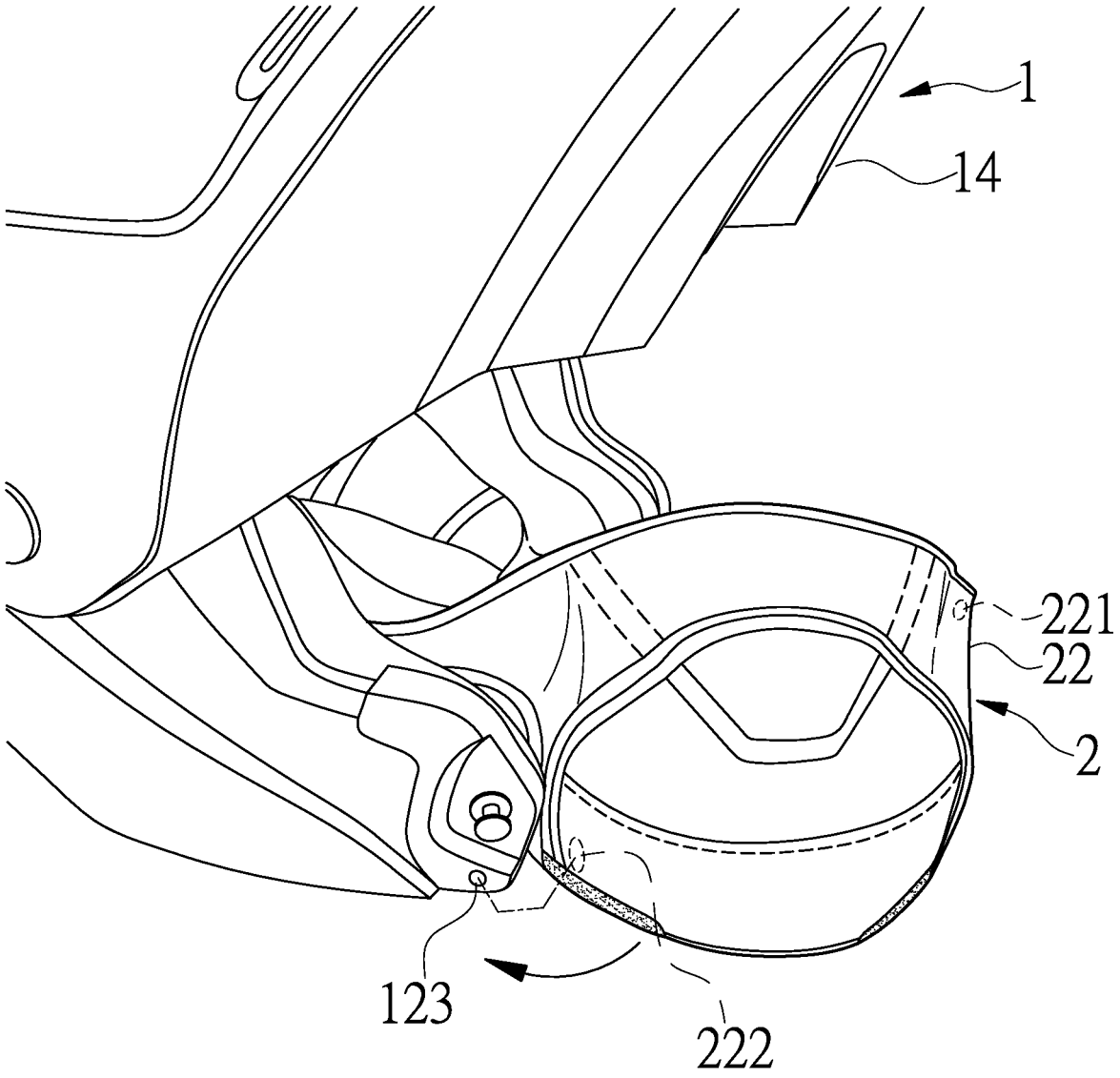
FIG. 3 is a schematic view of the present invention in which the breathing nose mask is lifted.
Figure 4:
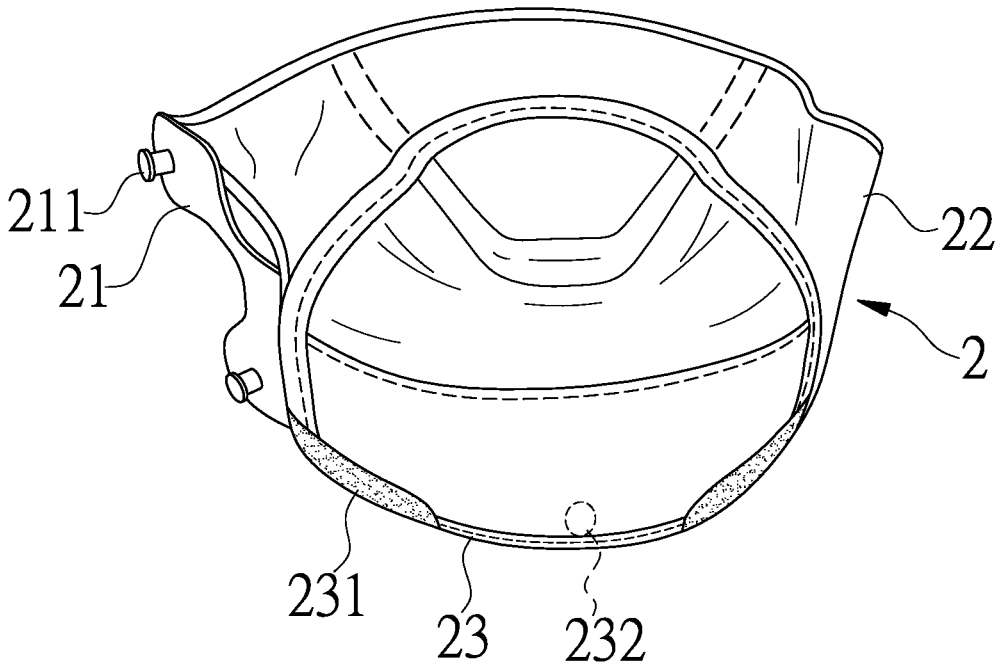
FIG. 4 is a three-dimensional view of the breathing nose mask of the present invention.
Figure 5:
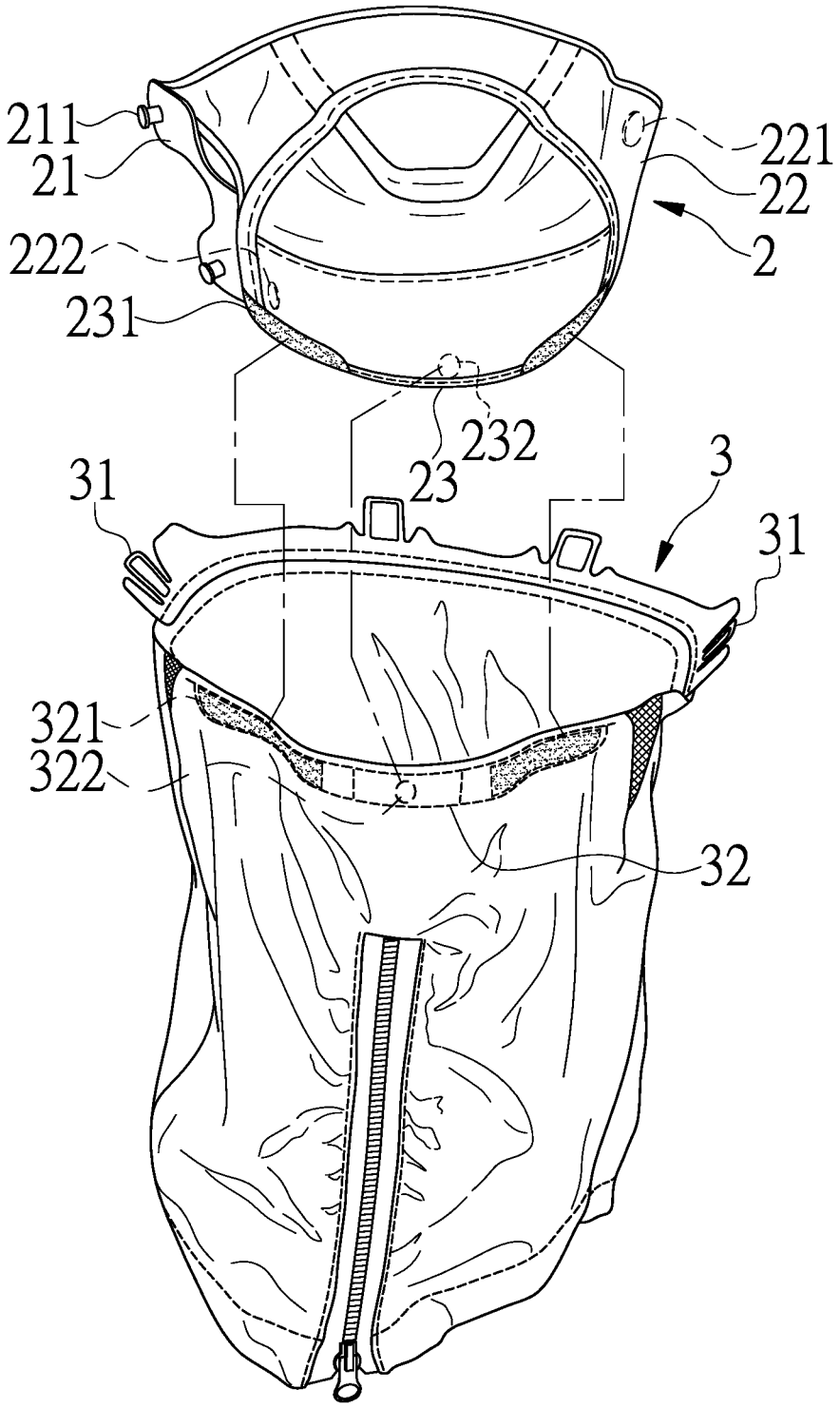
FIG. 5 is a three-dimensional exploded view of the breathing nose mask and the cold-resistant cover of the present invention.
Figure 6:
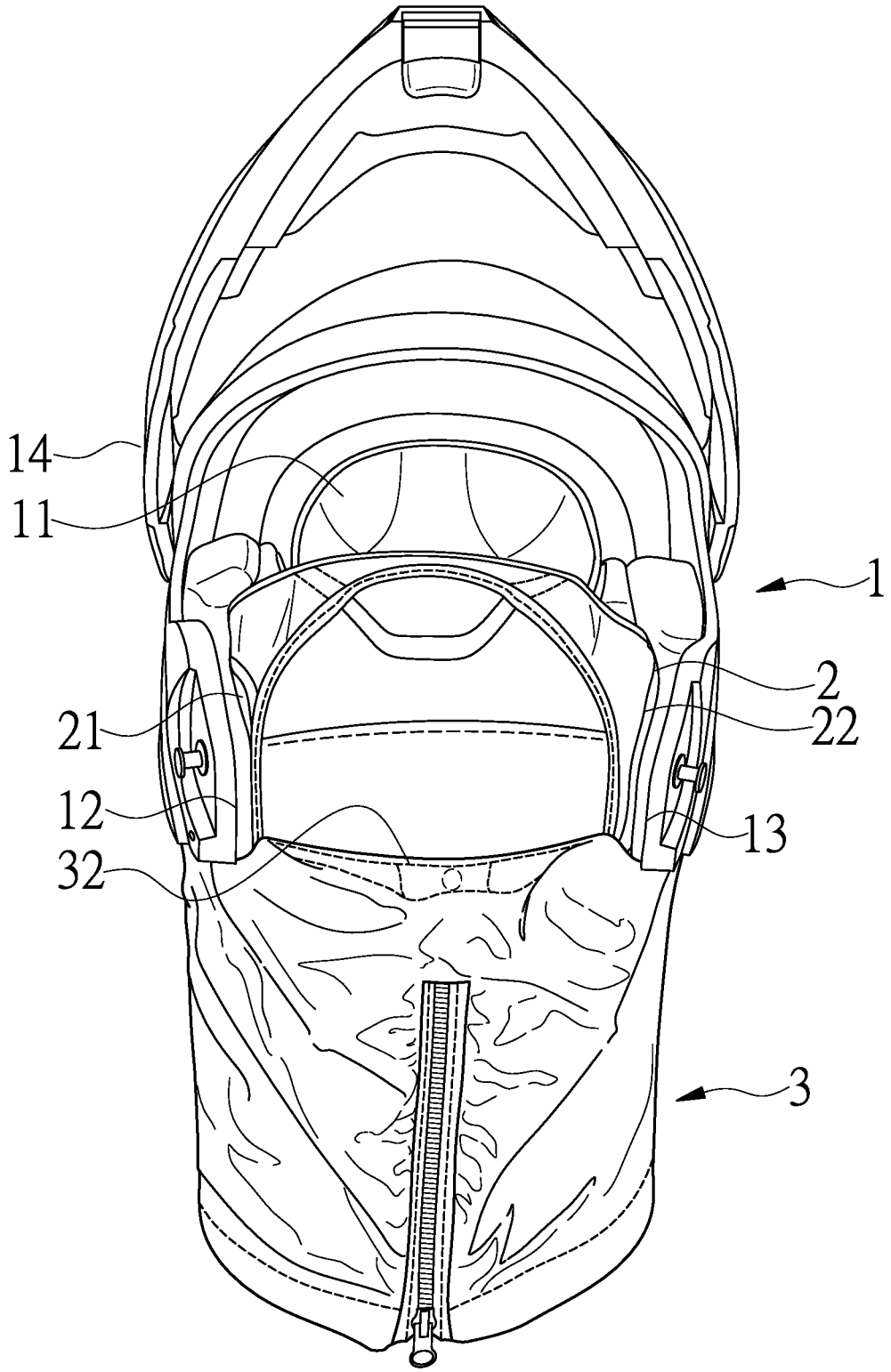
FIG. 6 is a schematic view of the breathing nose mask, cold-resistant cover, and helmet combination of the present invention.

For a more complete disclosure of the technical content for accomplishing the purpose of the present invention, the following is described in detail and reference is made to the disclosed drawings and reference numbers:

First of all, please refer to FIGS. 1 to 3. The flip-up helmet of the present invention comprises: a body 1, the front end of which is a hollow portion 11, and the body having a first side 12 and a second side 13, the inner wall surface of the first side 12 and the second side 13 being provided with a fixing hole 121 and a fixing hole 131, respectively, the fixing hole 121 being provided for fixedly snapping a first cheek lining 15 and the fixing hole 131 being provided for fixedly snapping a second cheek lining 16, and a first magnetic element 161 being installed in the second cheek lining 16. The inner wall surface of the first side 12 is further provided with a positioning hole 122, and a liftable face shield 14 is hinged to the front of the body 1, covering the entire hollow portion 11; a breathing nose mask 2, which has a positioning pin 211 at the first end 21 of the breathing nose mask 2, and the positioning pin 211 can be combined with the positioning hole 122 of the first side 12 of the body 1, so that the first end 21 of the breathing nose mask 2 is fixed to the first side 12 of the body 1, the second end 22 of the breathing nose mask 2 is provided with a second magnetic element 221, which is arranged corresponding to the first magnetic element 161, so that both of them can easily attract or separate from each other by magnetism, so that the second end 22 of the breathing nose mask 2 can be movably combined with or separated from the second side 13 of the body 1, constituting a liftable and openable breathing nose mask 2.

When the wearer needs to open the breathing nose mask 2 by first lifting up the face shield 14, since the breathing nose mask 2 is not combined with the face shield 14, so that the face shield 14 can be easily and unobstructedly lifted up to the maximum position, in a further embodiment of the present invention, a sixth magnetic element 123 is installed at the outer edge of the first side 12 of the flip-up helmet body 1, and a third magnetic element 222 is installed near the first end 21 of the breathing nose mask 2. When the breathing nose mask 2 is lifted, the second magnetic element 221 is separated from the first magnetic element 161, and after the breathing nose mask 2 is lifted to a certain range, the third magnetic element 222 is attracted to the sixth magnetic element 123, thereby fixing the breathing nose mask 2 to the outside of the body 1 which can facilitate the wearer to eat or drink water. When the wearer finishes eating and moves the second end 22 of the breathing nose mask 2 to the second side 13 of the body 1, the third magnetic element 222 is detached from the sixth magnetic element 123 and the second end 22 of the breathing nose mask 2 moves to the second side 13 of the body 1, the first magnetic element 161 and the second magnetic element 221 can easily attract each other by magnetism, so that the breathing nose mask 2 can be completely covered on the wearer's nose to prevent the breathing vapor from rising and the fogging on the face shield 14 from affecting the wearer's vision.

Referring to FIGS. 1 and 4 to 6, in a further embodiment of the flip-up helmet of the present invention, the bottom outer edge of the breathing nose mask 2 has a bonding part 23 which includes two bonding pieces 231 located on both sides of the bottom outer edge of the breathing nose mask 2, the bonding piece 231 is a touch fastener, and a fourth magnetic element 232 is located in the middle of the two bonding pieces 231; a cold-resistant cover 3, which is a circular body surrounded by a cold-resistant fabric for wrapping around the neck of the wearer to keep warm, wherein the upper edge of the cold-resistant cover 3 has a binding piece 31 which can be combined to the bottom of the body 1, and the binding piece 31 can be a touch fastener or a plastic buckle, the upper front edge of the cold-resistant cover 3 has a binding part 32 corresponding to the bonding part 23, which has two connecting pieces 321 and which are the touch fasteners, and a fifth magnetic element 232 located in the middle of the two connecting pieces 321. In the assembly of the embodiment, the binding pieces 31 of the cold-resistant cover 3 are combined with the bottom of the body 1, the fifth magnetic element 322 of the cold-resistant cover 3 and the fourth magnetic element 232 at the bottom of the breathing nose mask 2 are attracted to each other, and the connecting pieces 321 of the cold-resistant cover 3 are combined with the bonding pieces 231 at both sides of the bottom edge of the breathing nose mask 2, respectively. Since the fifth magnetic element 322 and the fourth magnetic element 232 are installed in the middle position, it can ensure that the connecting pieces 321 and the bonding pieces 231 can be properly joined to avoid incomplete joining which causes cold air to be blown into the inside of the helmet and makes the wearer uncomfortable. When the wearer needs to eat, he can first lift up the face shield 14, then pull down the binding part 32 at the upper edge of the cold-resistant cover 3, so that the binding part 32 is detached from the bonding part 23 of the breathing nose mask 2, the wearer can easily lift and open the breathing nose mask 2, constituting a convenient eating and cold-preventing effect of the flip-up helmet.

Therefore, the use of the flip-up helmet of the present invention can obviously achieve the following effects:

1. The present invention combines the breathing nose mask in the body of the flip-up helmet, when the wearer opens the liftable face shield will not obstruct the lifting range of the face shield, so that the wearer has a larger space to facilitate eating.
2. When the wearer does not need to use the breathing nose mask, it can be easily removed from the helmet for storage by using the positioning pins, which can be directly detached from the positioning holes, it does not affect the structure of the helmet body.
3. The combination of the cold-resistant cover and the breathing nose mask of the present invention makes it unnecessary for the wearer to remove the helmet, which can be lifted off for eating or drinking water, and at the same time has the effect of being cold-resistant.

However, the above is only a better embodiment of the present invention and is not intended to limit the scope of implementation of the present invention. All variations and modifications that do not deviate from the technical spirit of the present invention are covered by the claims of the present invention.

In summary, the present invention has indeed broken with tradition and has improved and innovative creative content that can be implemented. It should meet the legal requirements of an invention patent.

What is claimed is:

1. A flip-up helmet with a breathing nose mask, comprising: a body, a front end of which is a hollow portion, and the body having a first side and a second side, the first side being combined with a first cheek lining, the second side being combined with a second cheek lining, the second cheek lining being provided with a first magnetic element, and the front end of the body being installed with a liftable face shield covered over the entire hollow portion; and a breathing nose mask, a first end of which is fixed to the first side of the body, a second end of the breathing nose mask being provided with a second magnetic element for attracting with the first magnetic element, so that the second end of the breathing nose mask is movably combined with the second side of the body or away from it, and a bottom of the breathing nose mask having a bonding part for a cold-resistant cover to be combined together to form a helmet with cold-resistant effect, wherein a fifth magnetic element of the cold-resistant cover and a fourth magnetic element at the bottom of the breathing nose mask are attracted to each other, and two connecting pieces of the cold-resistant cover are combined with two corresponding bonding pieces at both sides of the bottom edge of the breathing nose mask, respectively to ensure that the connecting pieces and the bonding pieces are properly engaged.

2. The flip-up helmet with a breathing nose mask according to claim 1, wherein, the breathing nose mask has a third magnetic element near the first end and an outer edge of the first side of the body has a sixth magnetic element for attracting the third magnetic element so that the lifted breathing nose mask is secured to the sixth magnetic element by the third magnetic element.

3. The flip-up helmet with a breathing nose mask according to claim 1, wherein, the two bonding pieces are located on two corresponding sides of the outer edge of the bottom of the breathing nose mask and the fourth magnetic element located in a middle portion of each of the two bonding pieces.

4. The flip-up helmet with a breathing nose mask according to claim 1, wherein, a bottom of the body is connected with a cold-resistant cover, an upper edge of the cold-resistant cover has a binding part which is connected to the body, and the fifth magnetic element is at a position corresponding to the bonding part of the breathing nose mask.

* * * * *